US006334425B1

(12) United States Patent
Nagatani et al.

(10) Patent No.: US 6,334,425 B1
(45) Date of Patent: Jan. 1, 2002

(54) AIR/FUEL RATIO CONTROL SYSTEM FOR INTERNAL COMBUSTION ENGINE

(75) Inventors: Shuji Nagatani; Masahiro Sato; Minoru Torii, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/559,742

(22) Filed: Apr. 27, 2000

(30) Foreign Application Priority Data

Apr. 28, 1999 (JP) ..... 11-122181

(51) Int. Cl.[7] ..... F02D 41/40
(52) U.S. Cl. ..... 123/295; 123/305
(58) Field of Search ..... 123/295, 305

(56) References Cited

U.S. PATENT DOCUMENTS 5,970,947 A * 10/1999 Iida et al. ..... 123/295

FOREIGN PATENT DOCUMENTS

JP 4-37264 6/1992
JP 5-79374 3/1993

* cited by examiner

*Primary Examiner*—Andrew M. Dolinar
(74) *Attorney, Agent, or Firm*—Arent Fox Kintner Plotkin & Kahn, PLLC

(57) ABSTRACT

An air/fuel ratio control system for a direct injection spark ignition internal combustion engine which is operated at an ultra-lean burn combustion or at a pre-mixture charged combustion. In the system, a charging efficiency correction coefficient for adjusting a charging efficiency of intake air is determined based at least on the determined desired air/fuel ratio and the form of combustion, and the desired air/fuel ratio is corrected by the coefficient. Then, the output fuel injection amount is determined based at least on the basic fuel injection amount and the corrected desired air/fuel ratio (desired air/fuel ratio correction coefficient). The charging efficiency correction coefficient is determined to be a less value when the engine is operated at the ultra-lean burn combustion than that when the engine is operated at the pre-mixture charged combustion. The coefficient is made different whether or not the operation of EGR is progress. With this, the desired air/fuel ratio is determined adequately and hence, the fuel injection amount can be determined adequately.

8 Claims, 5 Drawing Sheets

ECU
10
12
14
16
18
20
22
24
26
28
30
34
36
40
42
44
46
50
52
54
56
62
62a
62b
64
66
68
70
72
74
76
78
80

AIR/FUEL RATIO CONTROL SYSTEM FOR INTERNAL COMBUSTION ENGINE

BACKGROUND OF THE INVENTION

1. Field of the Invention

This invention relates to an air/fuel ratio control system for an internal combustion engine, more particularly to an air/fuel ratio control system for a direct injection spark ignition engine, in which gasoline fuel is directly injected into the combustion chamber of the engine.

2. Description of the Related Art

In the internal combustion engine, since the air-fuel mixture varies according to the cylinder temperature and the air/fuel ratio is a decisive factor to the cylinder temperature, it is known, from Japanese Laid-Open Patent Application No. Hei 5 (1993)-79374, for example, to correct the desired air/fuel ratio using a charging efficiency correction coefficient (for adjusting the charging efficiency of intake air) retrieved from table data (prepared beforehand) using the desired air/fuel ratio itself, and then to correct the basic fuel injection amount by the corrected desired air/fuel ratio to determine the output fuel injection amount. In this prior art, two kinds of table data are predetermined such that one of them is selected based on the engine speed.

Aside from the above, a direct injection spark ignition engine has recently been proposed in which gasoline fuel is directly injected into the combustion chamber such that an ultra-lean burn combustion or a stratified combustion (in an ultra lean air/fuel ratio) or the pre-mixture charged combustion (in a uniform air/fuel ratio) occurs in the engine as is disclosed in, for example, Japanese Patent Publication No. Hei 4 (1992)-37264.

In such a direct injection spark ignition engine, since the cylinder temperature is different with the form of combustion, the aforesaid prior art (Japanese Laid-Open Patent Application No. Hei 5 (1993)-79374) is not effective in determining the charging efficiency correction coefficient to be used for correcting the desired air/fuel ratio adequately, thereby making it difficult to determine the fuel injection amount appropriately.

SUMMARY OF THE INVENTION

An object of the present invention is therefore to provide an air/fuel ratio control system for an internal combustion engine, more particularly for a direct injection spark ignition engine which can determine the charging efficiency correction amount to be used for correcting the desired air/fuel ratio adequately and hence, can determine the fuel injection amount appropriately.

Further, the cylinder temperature varies according to the presence or absence of the operation of EGR (Exhaust Gas Recirculation) in which the exhaust gas is partially recirculated in the intake system of the engine.

An object of the present invention is therefore to provide an air/fuel ratio control system for an internal combustion engine, more particularly for a direct injection spark ignition engine which can determine the charging correction coefficient to be used for correcting the desired air/fuel ratio adequately, irrespective of the presence or absence of the EGR operation and hence, can determine the fuel injection amount appropriately.

This invention achieves this object by providing a system for controlling an air/fuel ratio for a direct injection spark ignition engine which is operated at one of two combustion forms including an ultra-lean burn combustion and a pre-mixture charged combustion; comprising: engine operating condition detecting means for detecting operating conditions of the engine at least including an engine speed and an engine load; basic fuel injection amount determining means for determining a basic fuel injection amount based at least on the detected engine speed and the engine load of the engine operating conditions; desired air/fuel ratio determining means for determining a desired air/fuel ratio of exhaust gas produced by the engine; combustion form discriminating means for discriminating at which form of combustion the engine is operated; charging efficiency correction coefficient determining means for determining a charging efficiency correction coefficient for adjusting a charging efficiency of intake air based at least on the determined desired air/fuel ratio and the form of combustion at which the engine is operated; desired air/fuel ratio correcting means for correcting the desired air/fuel ratio based on the determined charging efficiency correction coefficient; output fuel injection amount determining means for determining an output fuel injection amount by correcting the basic fuel injection amount at least by the corrected desired air/fuel ratio; and fuel injecting means for injecting fuel into a cylinder of the engine based on the determined output fuel injection amount.

BRIEF EXPLANATION OF THE DRAWINGS

This and other objects and advantages of the invention will be more apparent from the following description and drawings, in which.

DETAILED DESCRIPTION OF THE PREFERRED EMBODIMENTS

Embodiments of the present invention will now be explained with reference to the drawings.

Figure 1:
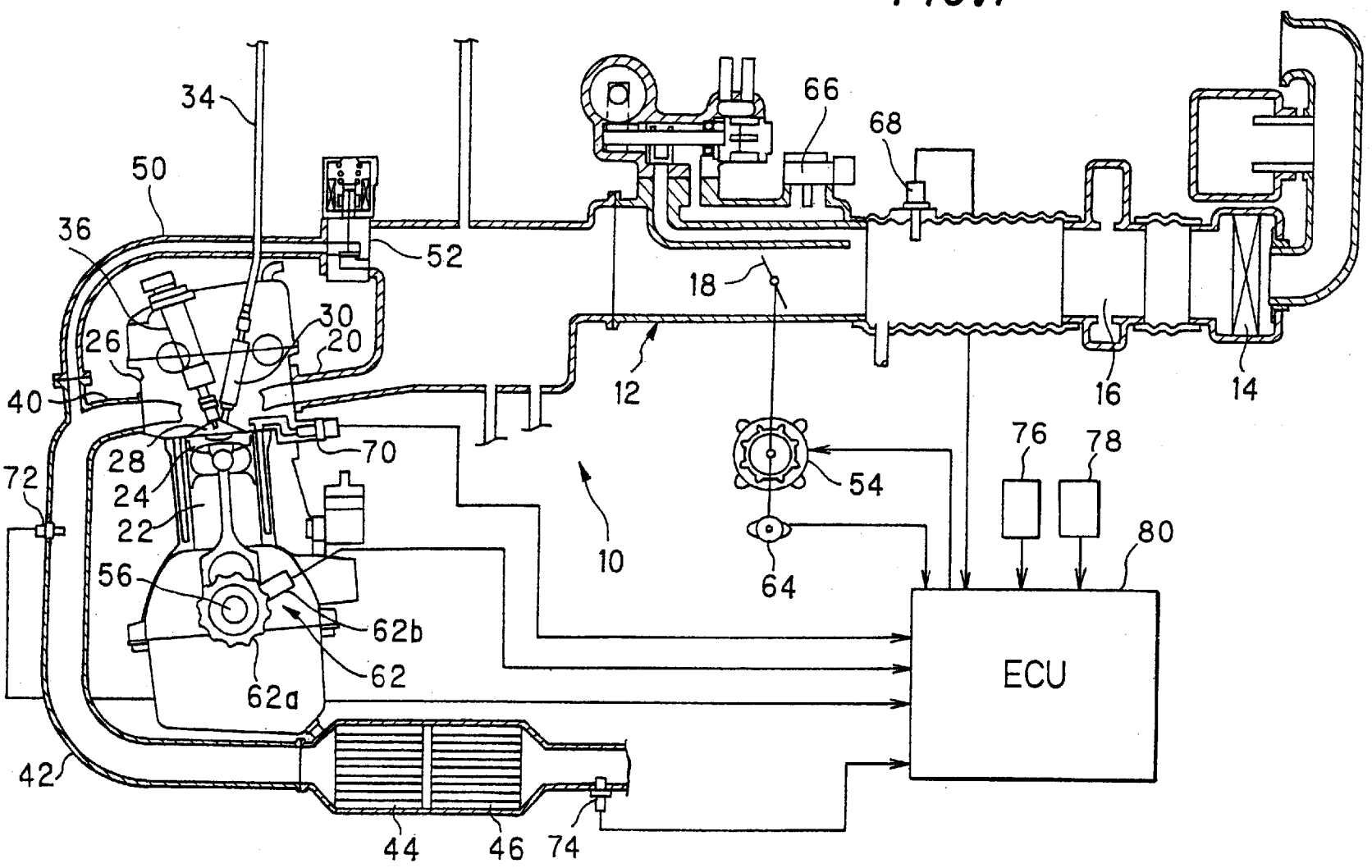
FIG. 1 is an overall schematic view showing an air/fuel ratio control system for an internal combustion engine according to an embodiment of the invention.

FIG. 1 is an overall schematic view of an air/fuel ratio control system for an internal combustion engine according to an embodiment of the invention.

Reference numeral 10 in this figure designates an OHC in-line four-cylinder internal combustion engine. Air drawn into an air intake pipe 12 through an air cleaner 14 mounted on its far end flows through a surge tank 16 and an intake manifold 20, while the flow thereof is adjusted by a throttle valve 18, to two intake valves (neither shown) of respective one of the first to fourth cylinders 22 (for brevity of illustration, only one is shown in the figure).

Each cylinder 22 has a piston 24 which is displaceable in the cylinder 22. The top of the piston 24 is recessed such that a combustion chamber 28 is formed in a space defined by the recessed cylinder top and the inner wall of a cylinder head (and the inner wall of the cylinder 22). A fuel injector 30 is provided in the vicinity of the center of the ceiling of the combustion chamber 28. The fuel injector 30 is connected to a fuel supply pipe 34 and is supplied with pressurized fuel (gasoline) from a fuel tank (not shown) pumped by a pump (not shown) and injects fuel directly into the combustion chamber 28 when opened. The injected fuel mixes with the air and forms the air-fuel mixture.

A spark plug 36 is provided in the vicinity of the fuel injector 30 which is supplied with electric energy from an ignition system including an ignition coil (neither shown) and ignites the air-fuel mixture at a predetermined ignition timing in the order of the first, the third, the fourth and the second cylinder. The resulting combustion of the air-fuel mixture drives down the piston 24.

Thus, the engine 10 is a direct injection spark ignition engine in which the gasoline fuel is directly injected into the combustion chamber 28 of respective cylinders 22 through the fuel injector 30.

The exhaust gas produced by the combustion is discharged through two exhaust valves (neither shown) into an exhaust manifold 40, from where it passes through an exhaust pipe 42 to a catalytic converter 44 (for removing NOx in the exhaust gas) and a second catalytic converter 46 (three-way catalyst for removing NOx, CO and HC in the exhaust gas) to be purified and then flows out of the engine 10.

The exhaust pipe 42 is connected, at a location downstream of the confluence point of the exhaust manifold 40, to the air intake pipe 12 by an EGR conduit 50 so as to recirculate the exhaust gas partially in the operation of EGR (Exhaust Gas Recirculation). An EGR control valve 52 is provided at the EGR conduit 50 to regulate the amount of EGR.

The throttle valve 18 is not mechanically linked with an accelerator pedal (not shown) installed at the floor of a vehicle operator scat (not shown), but is connected to a stepper motor 54 to be driven by the motor to open/close the air intake pipe 12. The throttle valve 18 is operated in such a DBW (Drive-By-Wire) fashion.

The piston 24 is connected to a crankshaft 56 to rotate the same. A crank angle sensor 62 is installed in the vicinity of the crankshaft 56, which comprises a pulser 62*a* fixed to the rotating crankshaft 56 and an electromagnetic pickup 62*b* fixed in an opposing stationery position. The crank angle sensor 62 generates a cylinder discrimination signal (named "CYL") once every 720 crank angular degrees, a signal (named "TDC" (Top Dead Center)) at a predetermined BTDC crank angular position and a unit signal (named "CRK") at 30 crank angular degrees obtained by dividing the TDC signal intervals by six.

A throttle position sensor 64 is connected to the stepper motor 54 and generates a signal indicative of the opening degree of the throttle valve 18 (named "TH"). A manifold absolute pressure (MAP) sensor 66 is provided in the air intake pipe 12 downstream of the throttle valve 18 and generates a signal indicative of the engine load, more precisely the absolute manifold pressure (named "PBA") generated by the intake air flow there through a conduit (not shown).

An intake air temperature sensor 68 is provided at a location upstream of the throttle valve 18 (close to the air cleaner 14) and generates a signal indicative of the temperature of intake air (named "TA"). And a coolant temperature sensor 70 is installed in the vicinity of the cylinder 22 and generates a signal indicative of the temperature of an engine coolant (named "TW").

Further, a universal (or wide range) sensor (air-fuel ratio sensor) 72 is installed at the exhaust pipe 42 at a position upstream of the catalytic converters 44, 46 and generates a signal indicative of the exhaust air/fuel ratio that changes linearly in proportion to the oxygen concentration in the exhaust gas. This sensor 72 is hereinafter referred to as "LAF" sensor. In addition, an $O_2$ sensor (air-fuel ratio sensor) 74 is provided at a position downstream of the catalytic converters 44, 46 and generates a signal which changes each time the exhaust air/fuel turns from lean to rich and vice versa with respect to a stoichiometric air/fuel ratio.

Furthermore, an accelerator position sensor 76 is provided in the vicinity of the accelerator pedal which generates a signal indicative of the position (opening degree) of the accelerator pedal (named "θ AP"). And a vehicle speed sensor 78 is installed in the vicinity of a drive shaft (not shown ) of the vehicle (not shown) on which the engine 10 is mounted and generates a signal indicative of the vehicle running condition (vehicle speed named "V").

The outputs of the sensors are sent to an ECU (Electronic Control Unit) 80. The ECU 80 comprises a microcomputer having a CPU, a ROM, a RAM (all not shown), etc. The CRK signal generated by the crank angle sensor 62 is counted by a counter (not shown) in the ECU 80 and the engine speed NE is detected or calculated.

The operation of the air/fuel ratio control system for an internal combustion engine according to the embodiment will be explained with reference to FIG. 2. The program of this flow chart is executed at a predetermined crank angular position in the vicinity of TDC.

The program begins in S10 in which a basic fuel injection amount (named "TI") is determined or calculated. This is done by retrieving mapped data (whose characteristics are not shown) using the detected engine speed NE and the engine load (manifold absolute pressure PBA) as address data. The basic fuel injection amount TI is determined in terms of the opening period of the fuel injector 30.

The program then proceeds to S12 in which a desired air/fuel ratio correction coefficient (named "KCMD") is determined or calculated. In this system, a desired air/fuel ratio (named "KCMD"), which is a decisive factor for the cylinder temperature, is first determined or calculated. The desired air/fuel ratio KCMD is then multiplied by a charging efficiency correction coefficient for adjusting the charging efficiency of intake air (named "KETC") and the corrected value, i.e. the product is named the desired air/fuel ratio correction coefficient KCMDM.

Figure 3:
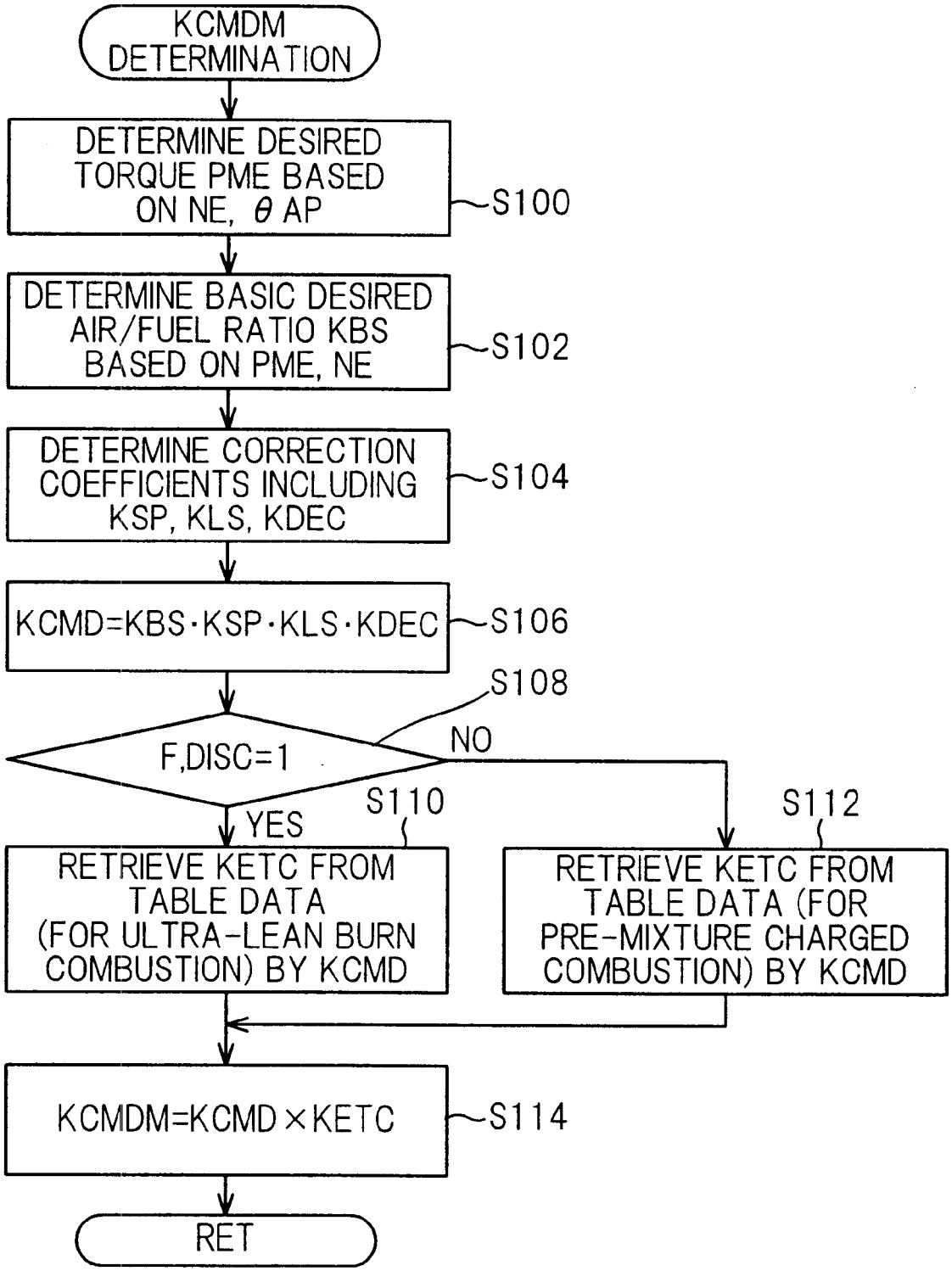
FIG. 3 is a flow chart showing the subroutine for determining a desired air/fuel ratio correction coefficient referred to in the flow chart of FIG. 2.

FIG. 3 is a flow chart showing the subroutine for this determination.

The program begins in S100 in which, since the engine 10 is a direct injection spark ignition engine, a desired torque (named "PME") to be generated by the engine 10 is determined based on the detected engine speed NE and the detected accelerator position θ AP.

The program then proceeds to S102 in which a basic desired air/fuel ratio (named "KBS") is retrieved from mapped data (whose characteristics are not shown) using the determined desired torque PME and the detected engine speed NE as address data.

The program then proceeds to S104 in which various correction coefficients including a vehicle speed correction coefficient (named "KSP"), a lean-burn correction coefficient (named "KLS"), a deceleration correction coefficient (named "KDEC") are determined.

The vehicle speed correction coefficient KSP is determined or calculated table data (whose characteristic is not shown) using the detected vehicle speed V as address data such that no surging occurs. The lean-burn correction coefficient KLS is determined or calculated to be a value using a lean-bum-conducting coefficient immediately before the fuel supply is cut off based on the engine operating conditions at that time. If the engine operation is not at a lean-burn-conducting region immediately before the fuel supply is cut off, the coefficient KLS is set to be 1.0 (indicating that no correction should be made). The deceleration correction coefficient KDEC is set to be a value in response to the deceleration of the engine 10. If the engine 10 is not decelerating, it is set to be 1.0 (indicating that no correction should be made).

In S104, other correction coefficients such as one based on the engine coolant temperature TW are determined. However, since they are mentioned in the aforesaid prior art (Japanese Laid-Open Patent Application No. Hei 5 (1993)-79374) and the gist of the invention does not reside in them, no further explanation will be made.

The program proceeds to S106 in which the desired air/fuel ratio KCMD is determined or calculated in a manner shown there by multiplying the basic desired air/fuel ratio KBS by the determined correction coefficients KSP, KLS, KDEC.

Specifically, the desired air/fuel ratio KCMD is determined such that the actual air/fuel ratio in the vicinity of the spark plug 36 falls within a range from 12.0:1 to 15.0:1, irrespective of the engine load, while the actual averaged air/fuel ratio (averaged air/fuel ratio throughout the cylinder 22) falls within a range from 12.0:1 to 15.0:1 at a high engine load, within a range exceeding thereof but up to 22.0:1 at a medium engine load, and within a range exceeding thereof but up to 60.0:1 at a low engine load.

As will be mentioned below, the fuel injection amount is determined based on the determined desired air/fuel ratio and is injected during the intake stroke at a high or medium engine load, and is injected during the compression stroke at a low engine load. The injected fuel mixes with the intake air and is ignited, resulting in two forms of combustion including the ultra-lean burn combustion (DISC (Direct Injection Stratified Charged) combustion) and the pre-mixture charged combustion.

The program then proceeds to S108 in which it is determined whether the bit of a flag F.DISC is set to 1. In a routine (not shown), the bit of the flag is set to 1 when it is determined that the engine 10 should be operated at the ultra-lean bum combustion, while it is reset to 0 when the engine 10 should be operated at the pre-mixture charged combustion. Therefore, the procedure in this step corresponds to determining whether the engine 10 is operated at the ultra-lean burn combustion.

Figure 4:
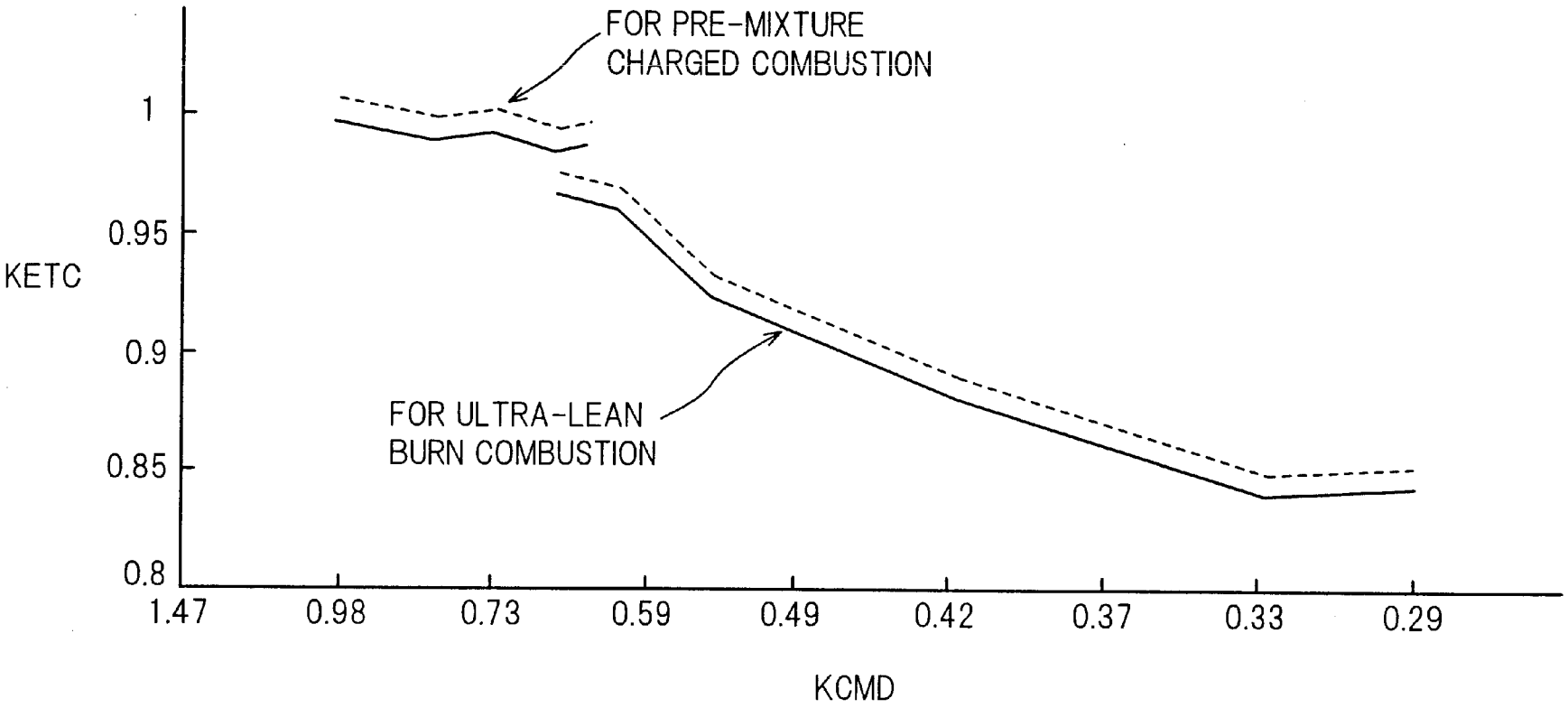
FIG. 4 is a graph showing characteristics of a charging efficiency correction coefficient referred to in the flow chart of FIG. 3.

When the result is affirmative, the program proceeds to S110 in which the charging efficiency correction coefficient KETC is determined or calculated by retrieving table data for the ultra-lean burn combustion (whose characteristic is shown in FIG. 4 by a solid line) using the determined desired air/fuel ratio KCMD as address data.

On the other hand, when the result is negative, the program proceeds to S112 in which the charging efficiency correction coefficient KETC is determined or calculated by retrieving table data for the pre-mixture charged combustion (whose characteristic is shown in FIG. 4 by a solid line) similarly using the determined desired air/fuel ratio KCMD as address data.

As mentioned above, since the intake air drawn in the cylinder 22 is cooled by the atomized fuel injected, the volume of air decreases and hence, the amount of intake air increases. For that reason, the charging efficiency correction coefficient KETC is determined based on the desired air/fuel ratio KCMD to correct the same and the corrected desired air/fuel ratio KCMD is named the desired air/fuel ratio correction coefficient KCMDM.

Further, this cooling effect of injected fuel is only obtainable in the pre-mixture charged combustion where fuel is injected (charged) during the intake stroke, and is not obtainable in the ultra-lean burn combustion where fuel is injected (charged) in the compression stroke (after the intake stroke). With this, the cylinder temperature is different with the pre-mixture charged combustion and the ultra-lean burn combustion as mentioned above.

In view of this, the system is configured such that, as illustrated in FIG. 4 by solid lines, the two kinds of characteristics of the charging efficiency correction coefficient KETC are prepared as the table data and based on the form of combustion, the characteristic corresponding thereto is selected.

Returning to the explanation of FIG. 3, the program proceeds to S114 in which the desired air/fuel ratio KCMD is multiplied by the determined charging efficiency correction coefficient KETC to be corrected and the resulting product is determined as the desired air/fuel ratio correction coefficient KCMDM. The desired air/fuel ratio KCMD and the desired air/fuel ratio correction coefficient KCMDM are, in fact, determined in terms of the equivalence ratio.

Figure 2:
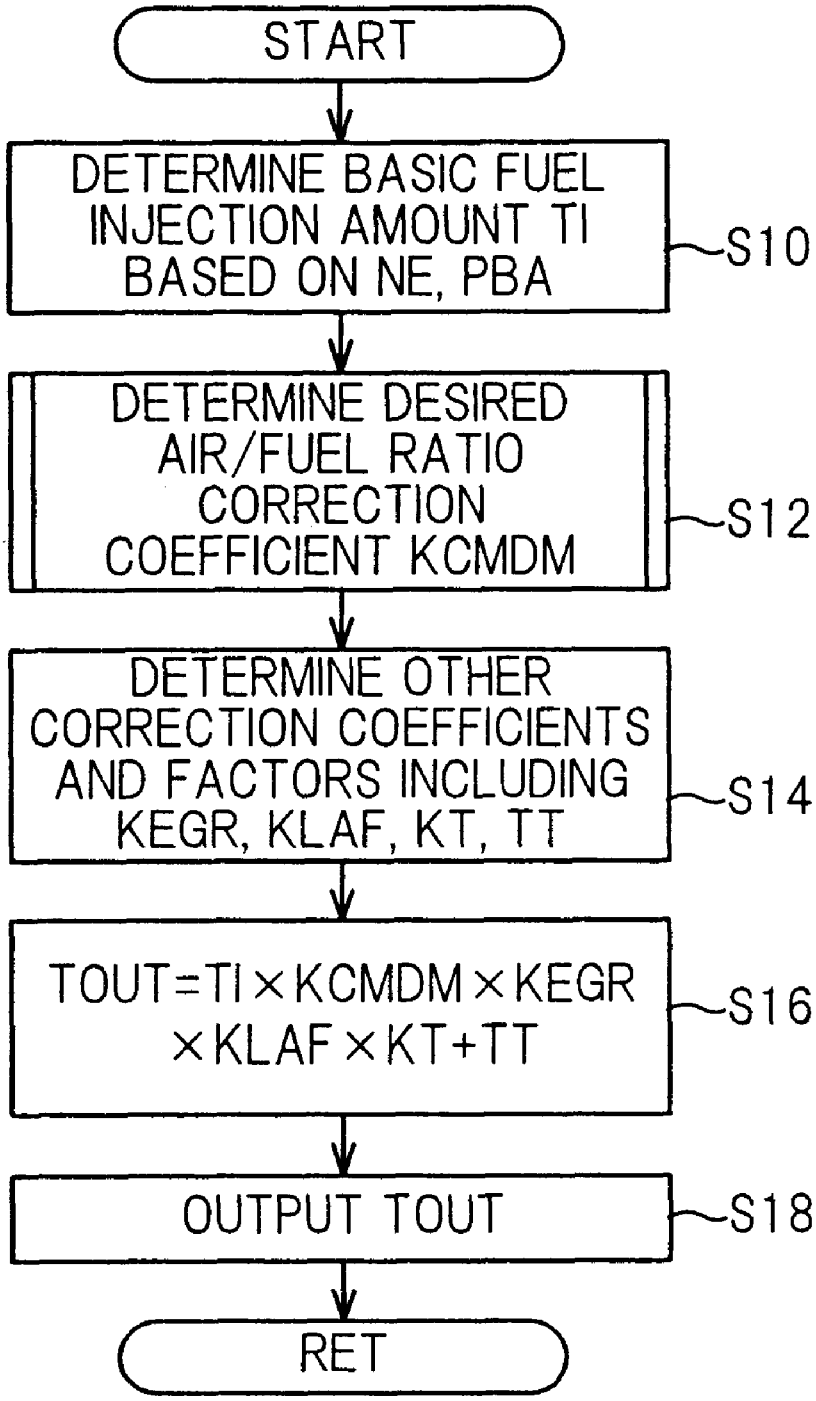
FIG. 2 is a flow chart showing the operation of the system illustrated in FIG. 1.

Returning to the explanation of FIG. 2, the program proceeds to S14 in which correction coefficients and correction factors (other than KCMDM) including KEGR, KLAF, KT, TT are determined or calculated. KEGR is a correction coefficient for correcting the disturbance caused by the operation of EGR and is determined based on the desired torque PME and the engine speed NE. KLAF is a feedback correction coefficient and is determined based on the output of the LAF sensor 72. KT is the product of other correction factors in multiplication form and TT is the sum of other correction factors in additive form (and subtraction form).

The program then proceeds to S16 in which an output fuel injection amount (named "TOUT") is determined or calculated in a manner shown there by correcting the basic fuel injection amount TI by the desired air/fuel ratio correction coefficient KCMDM and the other correction coefficients and the product factor and by adding the additive factor thereto.

The program then proceeds to S18 in which the output fuel injection amount TOUT is output such that the determined fuel injection amount is injected at a predetermined crank angle range. The injected fuel is ignited at a predetermined crank angular position corresponding to the ignition timing determined (in a routine not shown) based on the detected engine speed NE and the engine load (manifold absolute pressure PBA) and corrected by the detected coolant temperature TW and some similar parameters.

Having been configured in the foregoing manner, the system according to the embodiment can determine the charging efficiency correction coefficient KETC to be used for correcting the desired air/fuel ratio KCMD adequately, can determine the desired air/fuel ratio correction coefficient KCMDM adequately and hence, can determine the output fuel injection amount TOUT appropriately.

Figure 5:
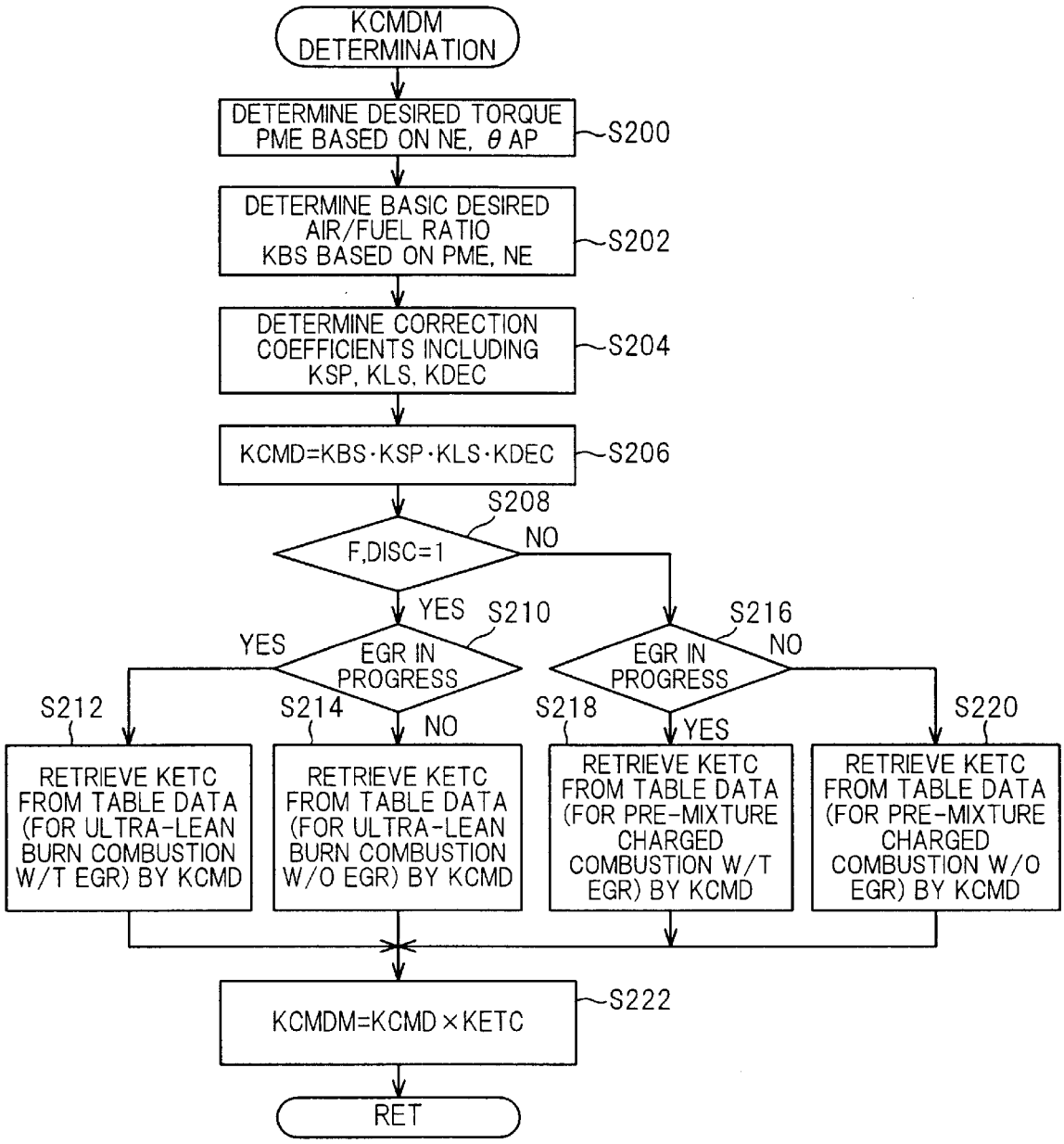
FIG. 5 is a view, similar to FIG. 3, but showing the operation of an air/fuel ratio control system for an internal combustion engine according to a second embodiment of the invention.

FIG. 5 is a view, similar to FIG. 3, but showing the operation of an air/fuel ratio control system for an internal combustion engine according to a second embodiment of the invention.

Explaining this with focus on the differences from the first embodiment, the program begins in S200 and proceeds, via S202 to S206, to S208 in which it is determined whether the bit of flag F.DISC is set to 1.

When the result is affirmative, the program proceeds to S210 in which it is determined whether the operation of EGR is in progress (i.e. the operation of EGR is present), and when the result in S210 is affirmative, the program proceeds to S212 in which the charging efficiency correction coefficient KETC is determined or calculated by retrieving table data for the ultra-lean burn combustion with the operation of EGR (whose characteristic is shown in FIG. 4 by dashed lines) using the determined desired air/fuel ratio KCMD as address data.

On the other hand, when the result is negative (the operation of EGR is absent), the program proceeds to S214 in which the charging efficiency correction coefficient KETC is determined or calculated by retrieving the table data for the ultra-lean burn combustion without the operation of EGR (shown in FIG. 4 by the solid line which is the same as that used in the first embodiment) similarly using the determined desired air/fuel ratio KCMD as address data.

On the other hand, when the result S208 is affirmative, the program proceeds to S216 in which it is determined whether the operation of EGR is in progress, and when the result in S216 if affirmative, the program proceeds to S218 in which the charging efficiency correction coefficient KETC is determined or calculated by retrieving table data for the pre-mixture charged combustion with the operation of EGR (whose characteristic is shown in FIG. 4 by dashed lines) using the determined desired air/fuel ratio KCMD as address data.

On the other hand, when the result is negative, the program proceeds to S220 in which the charging efficiency correction coefficient KETC is determined or calculated by retrieving the table data for the pre-mixture charged combustion without the operation of EGR (shown in FIG. 4 by the solid line which is the same as that used in the first embodiment.

Thus, since the cylinder temperature varies with the presence or absence of the operation of the EGR, the system according to the second embodiment is configured to make the charging efficiency correction coefficient KETC different based further on the determination whether the operation of EGR is in progress or not.

With this, the system according to the second embodiment can determine the charging efficiency correction coefficient KETC to be used for correcting the desired air/fuel ratio KCMD adequately, can determine the desired air/fuel ratio correction coefficient KCMDM adequately, irrespective of whether the operation of EGR is in progress or not, and hence, can determine the output fuel injection amount TOUT appropriately.

The embodiments are thus configured to have a system for controlling an air/fuel ratio for an internal combustion engine (10), including; engine operating condition detecting means (ECU 80, 62, 66) for detecting operating conditions of the engine at least including an engine speed (NE) and an engine load (PBA); basic fuel injection amount determining means (ECU 80, S10) for determining a basic fuel injection amount (TI) based at least on the detected engine speed (NE) and the engine load (PBA) of the engine operating conditions; desired air/fuel ratio determining means (ECU 80, S12, S100–S106, S200–S206) for determining a desired air/fuel ratio (KCMD) of exhaust gas produced by the engine (10); charging efficiency correction coefficient determining means (ECU 80, S110–S112, S212–S214) for determining a charging efficiency correction coefficient (KETC) for adjusting a charging efficiency of intake air based at least on the determined desired air/fuel ratio (KCMD); desired air/fuel ratio correcting means (ECU 80, S114, S222) for correcting the desired air/fuel ratio (KCMD) based on the determined charging efficiency correction coefficient (KETC); output fuel injection amount determining means (ECU 80, S16) for determining an output fuel injection amount (TOUT) by correcting the basic fuel injection amount (TI) at least by the corrected desired air/fuel ratio (the desired air/fuel ratio correction coefficient KCMDM); fuel injecting means (ECU 80, 30) for injecting fuel into a cylinder (22) of the engine (10) based on the determined output fuel injection amount (TOUT). In the system, the engine (10) is a direct injection spark ignition engine which is operated at one of two combustion forms including an ultra-lean burn combustion and at a pre-mixture charged combustion; and the system includes: combustion form discriminating means (ECU 80, S108, S208) for discriminating at which form of combustion the engine is operated; and the charging efficiency correction coefficient determining means determines the charging efficiency correction coefficient based at least on the determined desired air/fuel ratio and the form of combustion at which the engine is operated.

The system further includes; EGR operation determining means (ECU 80, S210, S216) for determining whether operation of EGR is present or absent; and the charging efficiency correction coefficient determining means determines the charging efficiency correction coefficient based at least on the determined desired air/fuel ratio, the form of combustion at which the engine is operated and the presence or absence of the operation of EGR (ECU 80, S212, S214, S218, S220).

In the system, the charging efficiency correction coefficient determining means determines the charging efficiency correction coefficient to a value, when the engine is operated at the ultra-lean burn combustion, which is relatively less than that when the engine is operated at the pre-mixture charged combustion.

In the above, "at least" means that any other parameter(s) may instead be used.

It should also be noted in the above, although the charging efficiency correction coefficient KETC is expressed in the multiplication form, it may instead by expressed in the additive or subtraction form.

While the invention has thus been shown and described with reference to specific embodiments, it should be noted that the invention is in no way limited to the details of the described arrangements but changes and modifications may be made without departing from the scope of the appended claims.

What is claimed is:

1. A system for controlling an air/fuel ratio for a direct injection spark ignition engine which is operated at one of two combustion forms including an ultra-lean burn combustion and a pre-mixture charged combustion; comprising:

engine operating condition detecting means for detecting operating conditions of the engine at least including an engine speed and an engine load;

basic fuel injection amount determining means for determining a basic fuel injection amount based at least on the detected engine speed and the engine load of the engine operating conditions;

desired air/fuel ratio determining means for determining a desired air/fuel ratio of exhaust gas produced by the engine;

combustion form discriminating means for discriminating at which form of combustion the engine is operated;

charging efficiency correction coefficient determining means for determining a charging efficiency correction coefficient for adjusting a charging efficiency of intake air based at least on the determined desired air/fuel ratio and the form of combustion at which the engine is operated;

desired air/fuel ratio correcting means for correcting the desired air/fuel ratio based on the determined charging efficiency correction coefficient;

output fuel injection amount determining means for determining an output fuel injection amount by correcting the basic fuel injection amount at least by the corrected desired air/fuel ratio; and fuel injecting means for injecting fuel into a cylinder of the engine based on the determined output fuel injection amount.

2. A system according to claim 1, further including;

EGR operation determining means for determining whether operation of EGR is present or absent; and the charging efficiency correction coefficient determining means determines the charging efficiency correction coefficient based at least on the determined desired air/fuel ratio, the form of combustion at which the engine is operated and the presence or absence of the operation of EGR.

3. A system according to claim 1, wherein the charging efficiency correction coefficient determining means determines the charging efficiency correction coefficient to a value, when the engine is operated at the ultra-lean burn combustion, which is relatively less than that when the engine is operated at the pre-mixture charged combustion.

4. A system according to claim 2, wherein the charging efficiency correction coefficient determining means determines the charging efficiency correction coefficient to a value, when the engine is operated at the ultra-lean burn combustion, which is relatively less than that when the engine is operated at the pre-mixture charged combustion.

5. A method of controlling an air/fuel ratio for a direct injection spark ignition engine which is operated at one of two combustion forms including an ultra-lean burn combustion and a pre-mixture charged combustion; comprising the steps of:

detecting operating conditions of the engine at least including an engine speed and an engine load;

determining a basic fuel injection amount based at least on the detected engine speed and the engine load of the engine operating conditions;

determining a desired air/fuel ratio of exhaust gas produced by the engine;

discriminating at which form of combustion the engine is operated;

determining a charging efficiency correction coefficient for adjusting a charging efficiency of intake air based at least on the determined desired air/fuel ratio and the form of combustion at which the engine is operated;

correcting the desired air/fuel ratio based on the determined charging efficiency correction coefficient;

determining an output fuel injection amount by correcting the basic fuel injection amount at least by the corrected desired air/fuel ratio; and injecting fuel into a cylinder of the engine based on the determined output fuel injection amount.

6. A method according to claim 5, further including the step of;

determining whether operation of EGR is present or absent; and the step of charging efficiency correction coefficient determination determines the charging efficiency correction coefficient based at least on the determined desired air/fuel ratio, the form of combustion at which the engine is operated and the presence or absence of the operation of EGR.

7. A method according to claim 5, wherein the step of charging efficiency correction coefficient determination determines the charging efficiency correction coefficient to a value, when the engine is operated at the ultra-lean burn combustion, which is relatively less than that when the engine is operated at the pre-mixture charged combustion.

8. A method according to claim 5, wherein the step of charging efficiency correction coefficient determination determines the charging efficiency correction coefficient to a value, when the engine is operated at the ultra-lean burn combustion, which is relatively less than that when the engine is operated at the pre-mixture charged combustion.

* * * * *